US006408160B1

(12) United States Patent
Saito et al.

(10) Patent No.: US 6,408,160 B1
(45) Date of Patent: Jun. 18, 2002

(54) RUBBER FIXING ROLLER

(75) Inventors: Shinji Saito; Kesaaki Kitazawa, both of Tokyo (JP)

(73) Assignee: Nitto Kogyo Co., Ltd., Tokyo (JP)

( * ) Notice: Subject to any disclaimer, the term of this patent is extended or adjusted under 35 U.S.C. 154(b) by 0 days.

(21) Appl. No.: 09/734,585

(22) Filed: Dec. 13, 2000

(51) Int. Cl.[7] ..... G03G 15/20
(52) U.S. Cl. ..... 399/333; 219/216; 399/331
(58) Field of Search ..... 399/328, 329, 399/331, 333; 219/216, 243; 430/97, 124; 118/60; 432/60; 492/46, 53, 56

(56) References Cited

U.S. PATENT DOCUMENTS 4,136,613 A * 1/1979 Namiki ..... 118/60
4,329,565 A * 5/1982 Namiki et al. ..... 219/216
4,883,715 A * 11/1989 Kuge et al. ..... 219/216 X
5,621,510 A * 4/1997 Okuda et al. ..... 219/216 X
5,665,505 A * 9/1997 Malhotra ..... 430/97
6,183,929 B1 * 2/2001 Chow et al. ..... 430/124
6,282,399 B1 * 8/2001 Tokimatsu et al. ..... 399/333 X

FOREIGN PATENT DOCUMENTS

JP 60-225868 * 11/1985

* cited by examiner

*Primary Examiner*—Sophia S. Chen
(74) *Attorney, Agent, or Firm*—Armstrong, Westerman & Hattori, LLP

(57) ABSTRACT

A rubber fixing-roller includes a core and a non-foamed rubber elastic layer provided on the periphery of the core, the elastic layer including a peripheral surface having a predetermined outside diameter, the elastic layer being prepared in a predetermined heat capacity per unit volume by mixing a filler having low density and low specific heat.

18 Claims, 11 Drawing Sheets

RELATIONSHIP BETWEEN MIXING RATE OF GLASS BALOON AND CHANGING AMOUNT OF OUTSIDE DIAMETER

RUBBER FIXING ROLLER

FIELD OF THE INVENTION

The present invention relates to a rubber fixing-roller for use in a fixing apparatus which is applied for fusing and pressing unfixed toner on a sheet so as to fix the toner onto the sheet in copier, printer, facsimile, and the like.

BACKGROUND OF THE INVENTION

Heretofore, in a fixing apparatus of electrophotographic equipment, a so-called two rollers arrangement has been employed, which essentially includes two rollers, a heating roller having a heat source built-in and a pressing roller pressed to the heating roller with a predetermined pressure. In parallel with various related patent applications, this arrangement has been widely used.

In such two rollers arrangement, when it is required to provide a nip portion having a predetermined width at a position where the two rollers are rotatably contacted with each other, at least one of rollers must have a rubber elastic layer. Heretofore, the heating roller includes a rubber heat-resisting layer or fluororesin layer excellent in heat resistance because of having the heat source built-in, while the pressing roller includes a specific rubber elastic layer capable of assuring to form the nip portion.

If the rubber elastic layer of the pressing roller has a large heat capacity, the heating roller will be interfered in its temperature-rising due to the fact that the pressing roller in cool state contacts to the heating roller. As a result, a deteriorated temperature-rising rate causes a problem of long warming-up period of time. Particularly, as the heat conductivity of the rubber elastic roller is increased, this problem will come to the front, resulting in further extended warming-up period of time. Thus, it is desired to settle this problem.

In view of sufficiently providing the nip width described above, it is desirable to form the elastic layer of the pressing roller from a sponge rubber which has a high thermal responsiveness due to its low hardness or excellent elasticity, and extremely small heat capacity. This allows the rollers to be heated up to a desired fixing temperature in a short period of time. Applying this pressing roller to a fixing apparatus means to yield a capability for shortening the warming-up period of time, and is distinctly desirable from the standpoint of the recent demand for energy saving.

However, in the above case, the peripheral surface of the elastic layer in the pressing roller is heated up to the fixing temperature of, for example, about 180° C. by receiving heat from the heating roller or heat fixing-roller. While the elastic layer formed of sponge rubber is thermally expanded inevitably by being heated up to high temperature as described above, the level of this thermal expansion is different for each region of the elastic layer depending on differences in the foamed state of sponge rubber.

The outside diameter of the pressing roller applying sponge rubber to the elastic layer is randomly varied, or irregularly deformed, in the axial direction of the pressing roller, especially just after the warming-up operation has been completed.

As a result, when an unfixed sheet supporting unfixed toner is passed through the nip portion just after the completion of the warming-up operation, the unfixed sheet tends to have corrugations due to the irregularities on the peripheral surface of the pressing roller. When such corrugations have been created in the unfixed sheet, the sheet with the corrugations loses its utility value even if a toner image can successfully fixed thereon. Taking in the broad sense, this problematically corresponds to one defect in fixing operation.

SUMMARY OF THE INVENTION

The present invention is developed to solve the problems described above. It is one object of the present invention to provide a rubber fixing-roller capable of increasing temperature-rising rate of a fixing member by limiting the rate and amount of heat-transfer from the fixing member as small as possible.

It is another object of the present invention to provide a rubber fixing-roller capable of achieving a stable fixing operation when a sheet is passed therethrough by limiting the rate and amount of heat-transfer from the fixing member as small as possible.

It is still another object of the present invention to provide a rubber fixing apparatus capable of assuring a sufficient nip width and achieving a desired low heat capacity without using sponge rubber.

It is yet another object of the present invention to provide a rubber fixing apparatus capable of assuring a sufficient nip width and having no corrugation in a sheet even just after the completion of the warming-up operation.

It is a further object of the present invention to provide a rubber fixing apparatus capable of assuring a sufficient nip width and shortening the warming-up period of time.

In order to settle the problems and to achieve the objects described above, according to a first aspect of the present invention, a rubber fixing apparatus comprises a core and an elastic layer provided on the periphery of the core, the elastic layer is adapted to satisfy the following formula;

$$0.0004 \leqq A \leqq 0.0037$$

where A ($J^2/sec \cdot cm^4 \cdot K^2$) is a product value from the specific heat ($J/g \cdot K$), density ($g/cm^3$), and heat conductivity ($W/m \cdot K$) of said elastic layer In the rubber fixing-roller according to the first aspect of the present invention, the peripheral surface of the elastic layer may be covered with a releasing layer. This releasing layer may be formed of fluororesin.

In the rubber fixing-roller according to the first aspect of the present invention, the elastic layer may include a material having low specific heat and low heat conductivity dispersed in the elastic layer. This elastic layer may be formed of cellular rubber, preferably foamed rubber.

Alternatively, the elastic layer may be formed of a rubber with which a hollow filler, preferably a glass balloon, is dispersedly mixed as the material having low specific heat and low heat conductivity. The elastic layer may otherwise be formed of silicon rubber.

In the rubber fixing-roller according to the first aspect of the present invention, the rubber fixing-roller may be positioned to contact to the fixing member with a predetermined pressure.

According to a second aspect of the present invention, a rubber fixing-roller comprises a core and a non-foamed rubber elastic layer provided on the periphery of the core, the layer including a peripheral surface having a predetermined outside diameter, the layer being prepared in a predetermined heat capacity per unit volume by mixing a filler having low density and low specific heat.

In the rubber fixing-roller according to the second aspect of the present invention, the peripheral surface of the elastic layer may be covered with a releasing layer. This releasing layer may be formed of fluororesin.

In the rubber fixing-roller according to the second aspect of the present invention, the filler having low density and low specific heat may be a hollow material, or otherwise include a multi-component glass.

In the rubber fixing-roller according to the second aspect of the present invention, the rubber fixing-roller may be adapted to satisfy the following formula;

$$0.77 \leqq \rho \cdot c \leqq 1.32$$

where ρ is a density (g/cm$^3$) and c is a specific heat (J/g·K), in the range of from the peripheral surface of the elastic layer to at least 2 mm in depth.

In this case, the filler having low density and low specific heat is preferably not mixed in the range deeper than 2 mm in depth from the peripheral surface of the elastic layer.

In the rubber fixing-roller according to the second aspect of the present invention, the rubber fixing-roller may be adapted to satisfy the following formula;

$$0.77 \leqq \rho \cdot c \leqq 1.32$$

where ρ is a density (g/cm$^3$) and c is a specific heat (J/g·K), in the entire range of the elastic layer.

These and other aspects of the present invention are apparent in the following detailed description and claims, particularly when considered in conjunction with the accompanying drawings.

DETAILED DESCRIPTION OF THE PREFERRED EMBODIMENTS

Figure 1:
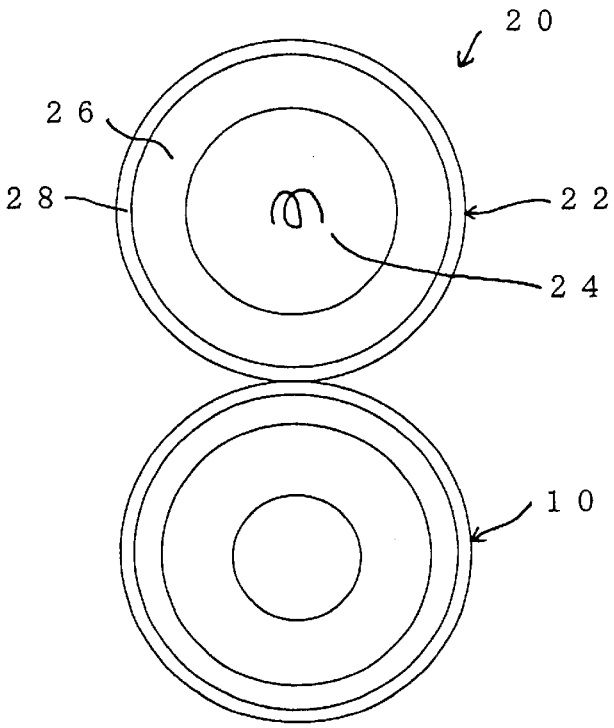
FIG. 1 is a schematic front view showing a fixing apparatus using a rubber fixing-roller according to one embodiment of the present invention.
Figure 2:
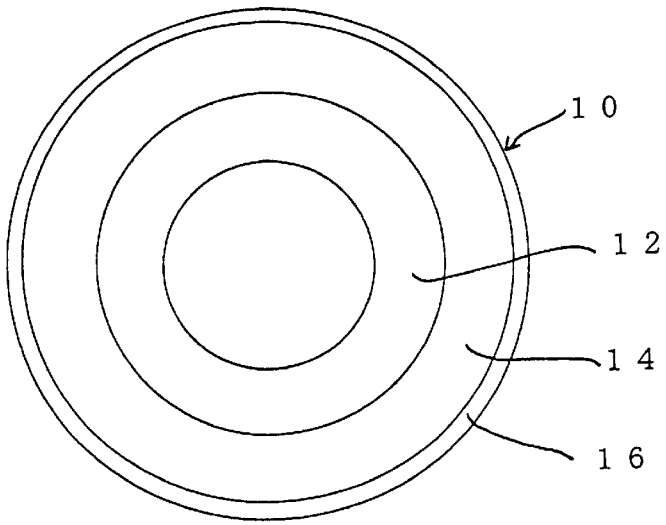
FIG. 2 is a cross-sectional view showing the pressing roller used as the rubber fixing-roller in FIG. 1.

Referring to FIG. 1 and FIG. 2 in the accompanying drawings, a rubber fixing-roller according to the first embodiment of to the present invention will now be described in detail.

With reference to FIG. 1, a fixing apparatus 20 provided with the rubber fixing-roller as the first embodiment will be firstly described. The fixing apparatus 20 includes a fixing housing (not shown) secured to a frame of an electronic image forming equipment (not shown), e.g. an electronic printer. In this fixing housing, the fixing apparatus 20 also includes a heat fixing-roller 22 as a fixing member, a pressing roller 10 as the rubber fixing-roller according to the first embodiment, which is pressed to the heat fixing-roller 22 with a predetermined pressure, and a heat source 24, such as a halogen lump, disposed in the heat fixing-roller to heat the peripheral surface of the heat fixing-roller 22.

As shown in FIG. 2, the pressing roller 10 includes an iron core 12 having a nickel-plated surface, a cylindrical elastic layer 14 made of cellular rubber (foamed rubber in this embodiment) and jointed tightly on the periphery of the core 12 with adhesive, and a releasing layer 16 having a predetermined thickness and formed of a fluororesin layer covering the peripheral surface of the elastic layer 14. In the first embodiment, the elastic layer is arranged in 5.5 mm of thickness and the pressing roller 10 is arranged in 25 mm of outside diameter.

Figure 3:
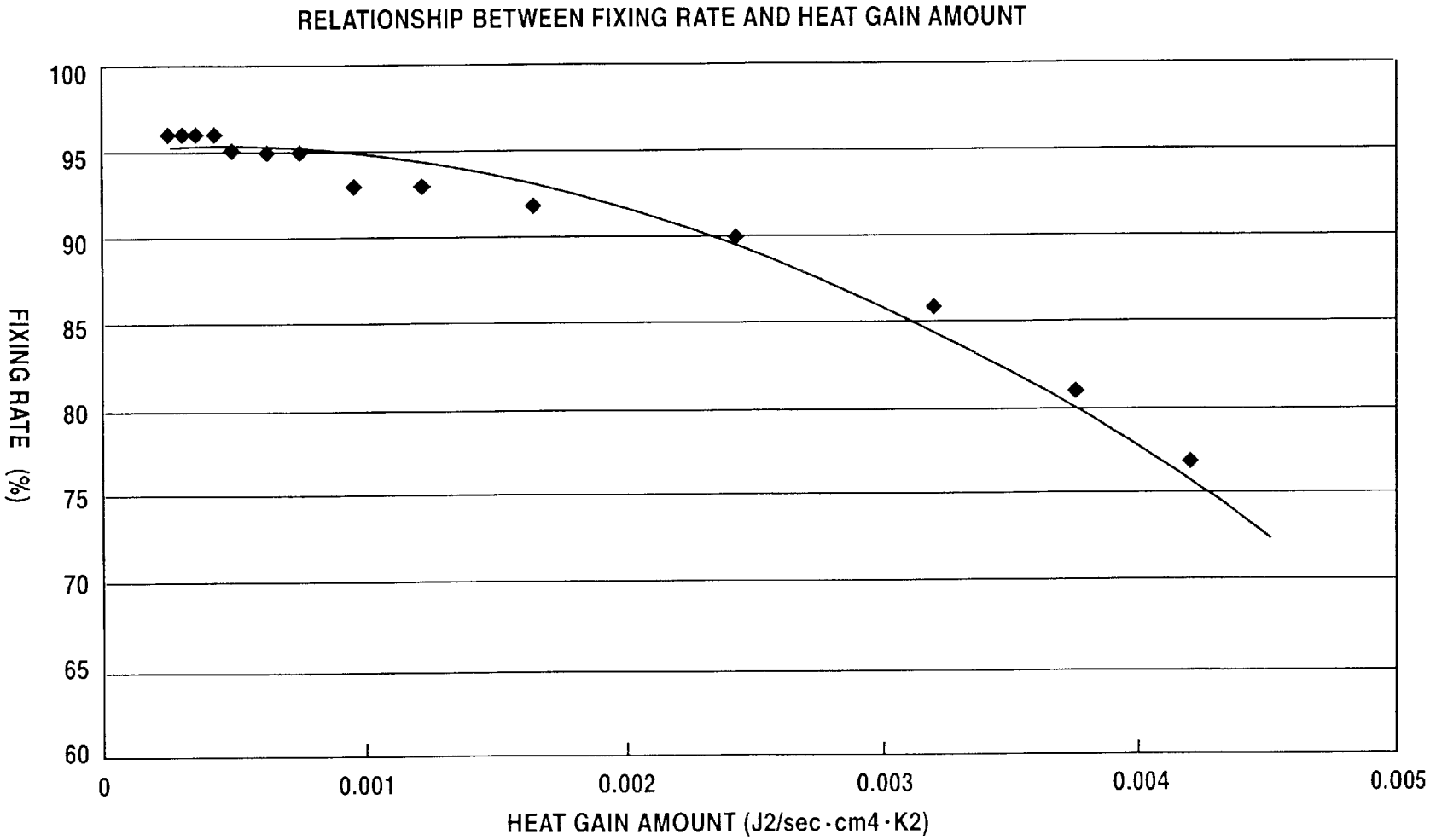
FIG. 3 is diagrammatic drawing showing the relationship between the fixing rate and the heat gain amount.

On the other hand, the heat fixing-roller 22 described above includes an aluminum core 26, and a releasing layer 28 composed of fluororesin coated on the periphery of the core 26. In this fixing apparatus, the heat fixing-roller 22 is arranged in 25 mm of outside diameter. Further, the heat fixing-roller 22 is rotatably driven at a predetermined rotational speed by driving means, not shown. With reference to FIG. 3, the elastic layer 14 of the pressing roller 10 as the rubber fixing-roller according to the first embodiment will now be described in detail.

The elastic layer 14 includes air or foam gas dispersed therein as a material having low specific heat and low heat conductivity. In this embodiment, the elastic layer 14 is formed of cellular rubber, more specifically, which is produced by foaming a material based on a silicon rubber designated by Model No: KE-90FU made by Shin-Etsu Chemical Co., Ltd. Thus, in the first embodiment, the foam gas as a material having low specific heat and low heat conductivity is mixed to and dispersed over the elastic layer 14.

The elastic layer 14 is also arranged in 150% of foaming ratio, i.e. 33% of porosity. The optimal range of the foaming ratio (porosity) will be described later.

Since the elastic layer 14 described above is formed of foamed rubber, both the density and heat conductivity of the elastic layer 14 decrease as its foaming ratio increases. As a result, the heat gain amount A per unit volume derived from multiplying the density and heat conductivity also decreases as the foaming ratio increases.

This heat gain amount A is a new parameter introduced by the inventors of the present invention in order to evaluate the rubber fixing-roller. According to this new parameter, smaller heat gain amount A indicates that the roller surface can be heated up in a shorter period of time without lowering the temperature of the heat fixing-roller.

However, excessively increasing the foaming ratio causes excessively increased compression set. As a result, the deformation in the portion for nip cannot be recovered, which makes the resulting roller useless. Thus, in view of average cell diameter, it is required to set an upper limit to the foaming ratio. It has also been proved that excessively decreased foaming ratio is undesirable in view of fixing rate. Finally, the inventors have discovered the presence of an optimal range for the heat gain amount A.

This optimal range of the heat gain amount A will now be verified.

With changing the foaming ratio between 102% and 325%, filling factor (%), density (g/cmE3) (where Ex indicates power of x. That is, cmE3 indicates $cm^3$, and cm E2 indicating $cm^2$. E−2 also indicates minus square or minus second power, and so forth.), specific heat (J/g·K), heat conductivity (W/m·K), compression set (%), and fixing rate (%) were determined respectively, and the temperature-rising time for rising up to 130° C. in each foaming ratio was also determined. This result is shown in Table 1.

As shown in Table 1, in view of compression set, the range up to 36% is the range where the deformation in the portion for nip can be reliably recovered. Thus, it was proved that the lower limit of the heat gain amount A was 4.19E−4 (≈0.0004).

The graph in FIG. 3 shows the correlation between the fixing rate (%) and the heat gain amount A.

The density (g/cmE3) indicates values derived from determining the volume and weight of the measuring object and then dividing the volume by the weight. The specific heat (J/g·K) indicates values determined using a thermal analyzer. The heat conductivity (W/m·K) indicates values determined by a QTM heat conductivity meter. The compression set (%) indicates values determined based on JIS K6301. The fixing rate (%) indicates values obtained by using the fixing apparatus 20 and determining the fixing rate of the first sheet passed through the nip after having idle cycles for 5 seconds after heating the heat fixing roller up to 185° C. under the stationary state of the rollers.

The temperature-rising time indicates values obtained by incorporating this fixing apparatus into an actual equipment (Able 1321: Fuji Xerox Co., Ltd.) and then determining the actual temperature-rising time for heating the surface of the pressing roller 10 up to 130° C.

Considering 85% of the required fixing rate, the graph shown in FIG. 3 was checked up by taking 85% or more of fixing rate as evaluation criteria. Then, it was proved that the upper limit of the heat gain amount A was 3.7E−3 (=0.0037).

Thus, it was proved that the optimal range of the heat gain amount A is the range of values satisfying the following inequality (1);

$$0.0004 \leqq A \leqq 0.0037 \quad (1)$$

In the first embodiment, since the foaming ration is arranged in 150%, the heat gain amount A is 0.00165 based on Table 1 and is apparently in the above optimal range.

As described above, according to the first embodiment, the new parameter of the heat gain amount A is intoduced and the elastic layer 14 of the pressing roller 10 as the rubber fixing-roller is then arranged to make the heat gain amount A get in the above optimal range, so that the pressing roller can be heated up in a shorter period of time without lowering the temperature of the heat fixing-roller when the pressing roller 10 is heated.

While the elastic layer 14 of the pressing roller 10 as the rubber fixing-roller has been described as that formed of sponge rubber (or foamed rubber) in the above embodiment, the present invention is not limited to this construction and non-foamed cellular rubber may also be applied to form the elastic layer. In this case, it is apparent that the foaming rate is not defined and only porosity will be defined.

Figure 4:
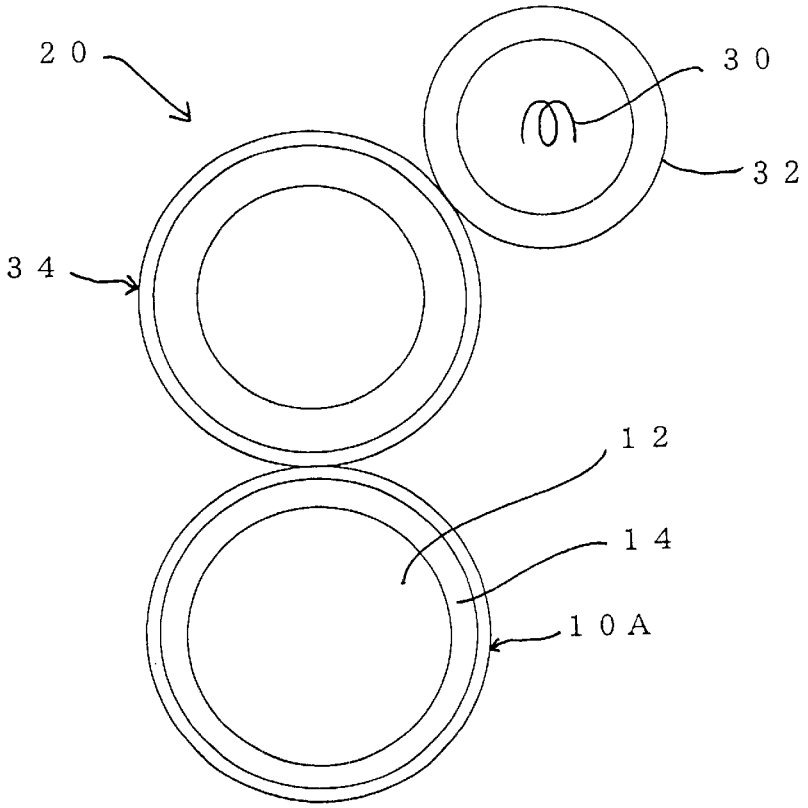
FIG. 4 is a schematic front view showing another fixing apparatus using a rubber fixing-roller of a first alternative example according to the present invention.
Figure 5:
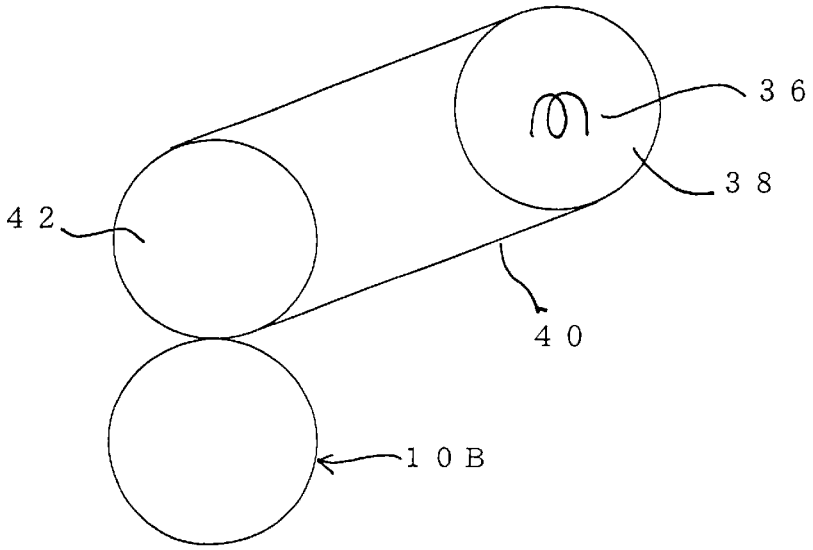
FIG. 5 is a schematic front view showing still another fixing apparatus using a rubber fixing-roller of a second alternative example according to the present invention.

Further, while the rubber fixing-roller has been described as the pressing roller positioned to contact to the heat fixing-roller with a predetermined pressure in the above embodiment, the present invention is not limited to such an arrangement. For instance, it may be configured as a first alterative example shown in FIG. 4, in which a fixing roller 34 heated directly from outside by a heating roller 32 having a heat source 30 built-in is provided as the fixing member, and a pressing roller 10A contacted to the fixing roller 34 with a predetermined pressure is applied with the rubber fixing-roller. It may also be configured as a second alternative example shown in FIG. 5, in which a fixing belt 40 formed of a heat transfer belt, which is endlessly wound around between a heating roller 38 having a heat source 36 built-in and a fixing roller 42 so as to transfer a heat from the heating roller 38, is provided as the fixing member, and a pressing roller 10B contacted to the fixing roller 42 through the fixing belt 40 with a predetermined pressure is applied with the rubber fixing-roller.

Further, while it has been described in the above embodiment that a roller type member was applied as the fixing member, the present invention is not limited to this construction. For instance, any belt type or sleeve type of fixing members may be apparently applied.

Further, while the material having low specific heat and low heat conductivity has been described as the cellular rubber with dispersed air therein or the foamed rubber with dispersed form gas therein in the above embodiment, the present invention is not limited to this construction. For instance, hollow filler, such as glass balloon, may be applied as the material having low specific heat and low heat conductivity.

Figure 6:
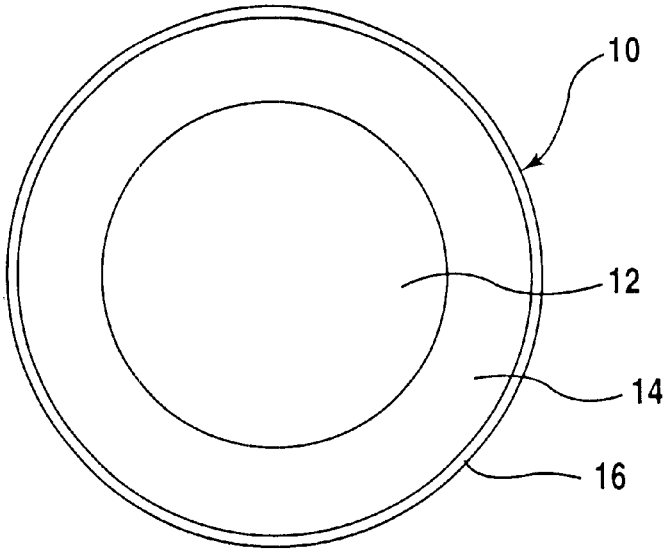
FIG. 6 is a front view showing a rubber fixing-roller according to another embodiment of the present invention.
Figure 7:
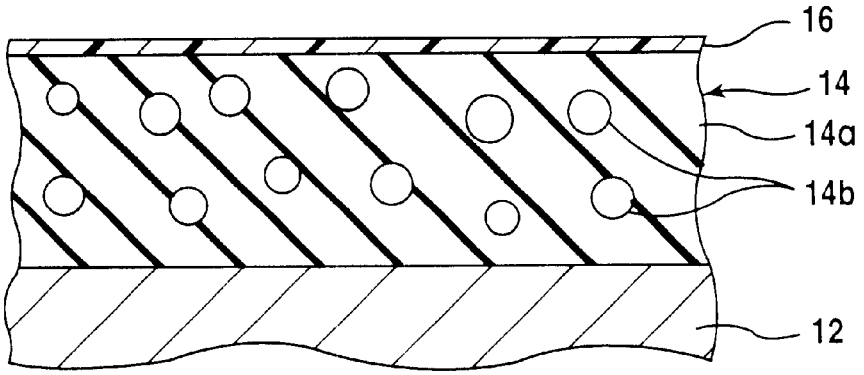
FIG. 7 is a cross-sectional view showing the rubber fixing-roller in FIG. 6.
Figure 8:
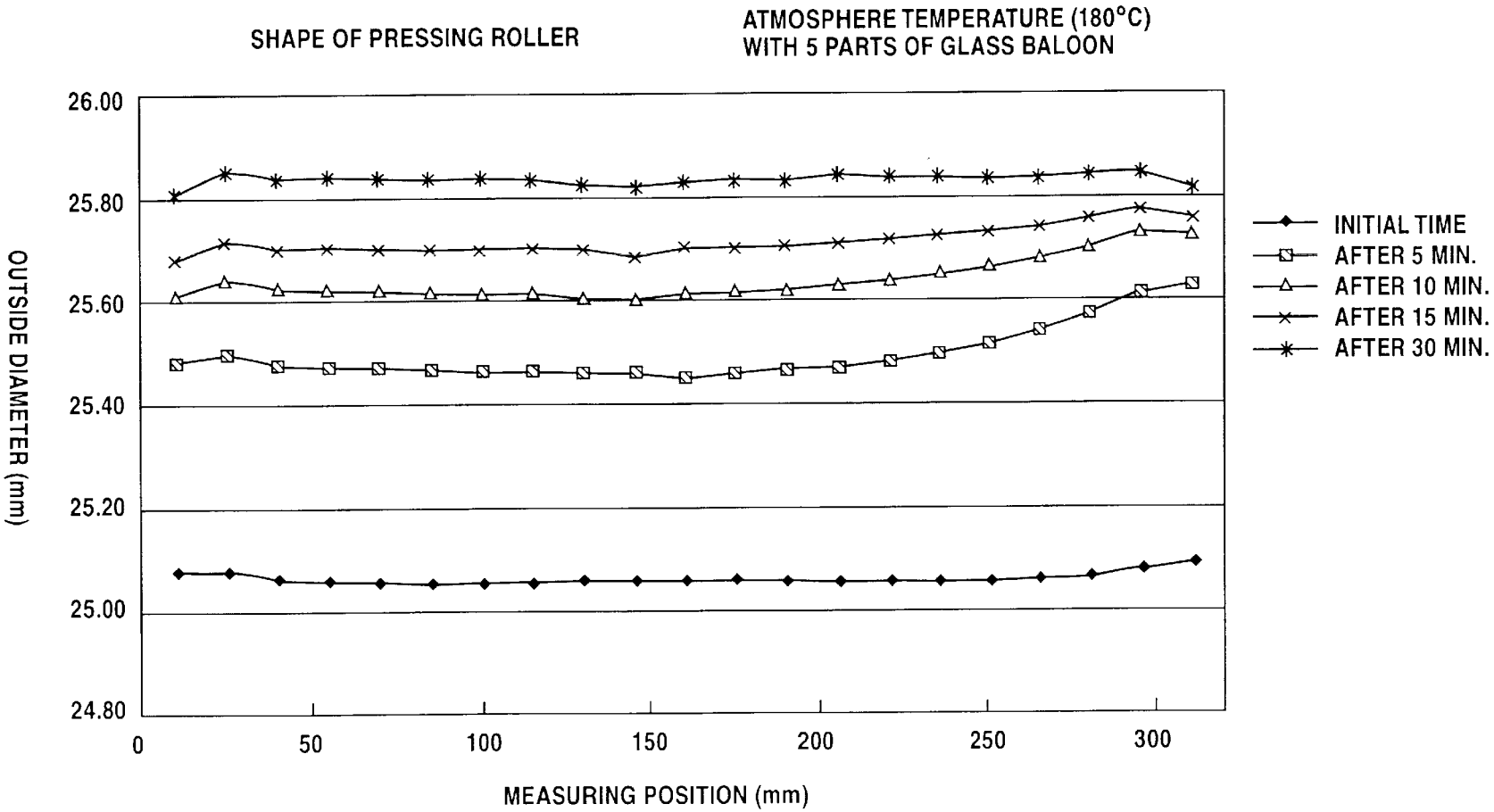
FIG. 8 is a diagrammatic view showing the change of the shape of a pressing roller over time, in case that the pressing roller having an elastic layer with the mixed glass balloon of 5 parts is heated up.
Figure 9:
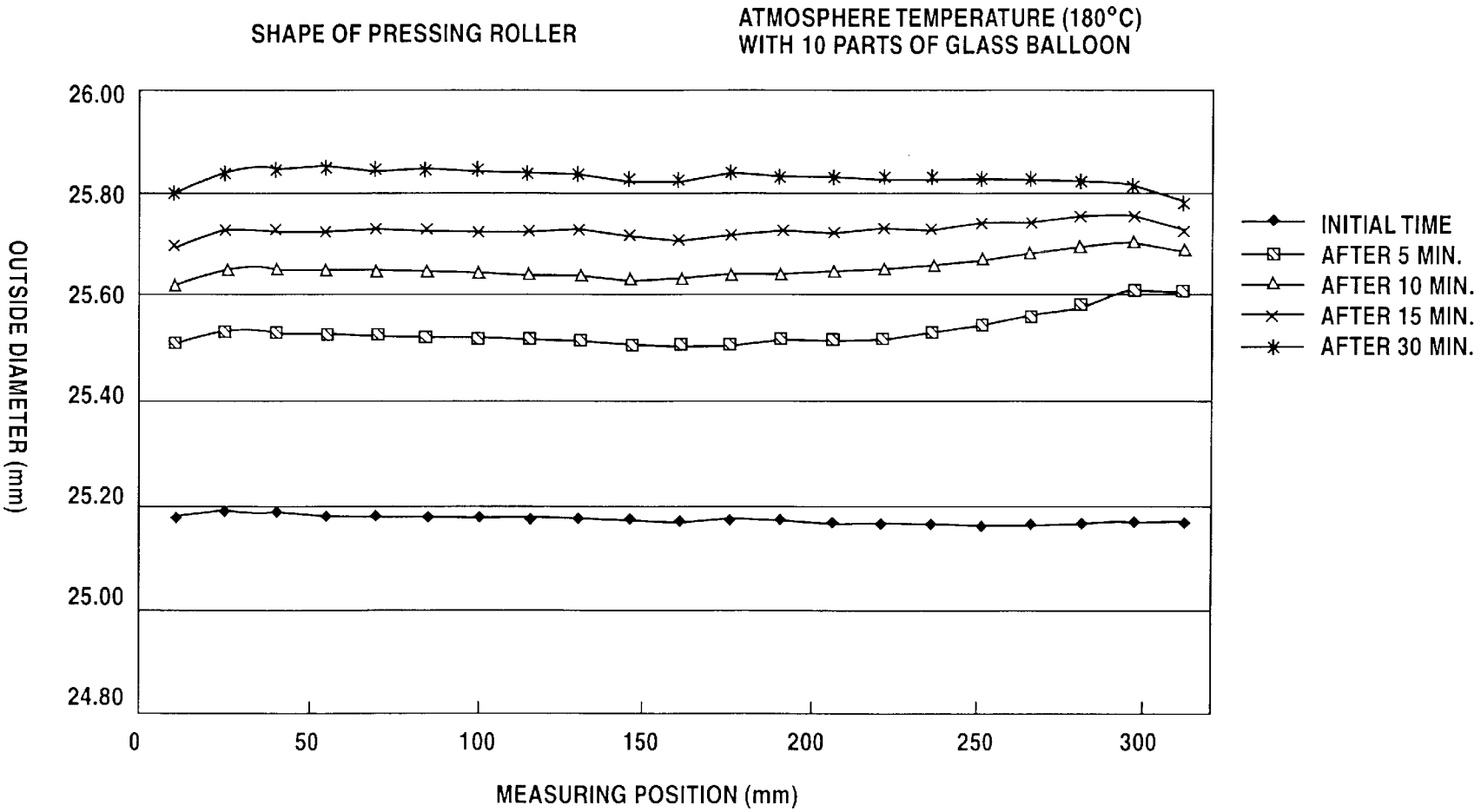
FIG. 9 is a diagrammatic view showing the change of the shape of a pressing roller over time, in case that the pressing roller having an elastic layer with the mixed glass balloon of 10 parts is heated up.
Figure 10:
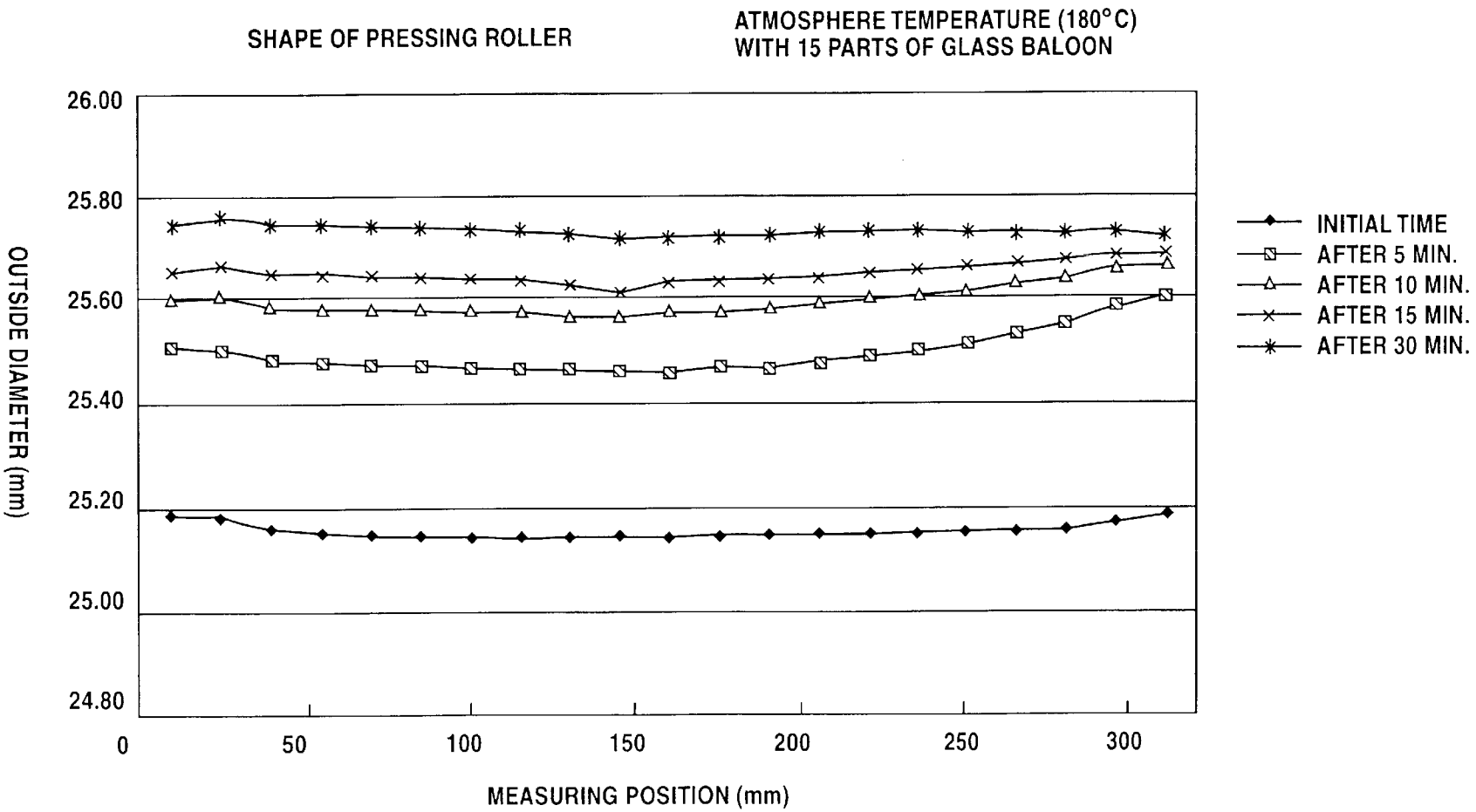
FIG. 10 is a diagrammatic view showing the change of the shape of a pressing roller over time, in case that the pressing roller having an elastic layer with the mixed glass balloon of 15 parts is heated up.

With reference to FIG. 6 and FIG. 7, the elastic layer 14 of the pressing roller according to the second embodiment will now be described in detail.

In the second embodiment, the elastic layer 14 is formed by preparing a non-foamed rubber 14*a* designated by Silicon Rubber Model No: X-34-1279A/B made by Shin-Etsu Chemical Co., Ltd as a base rubber and then dispersing a glass balloon 14*b* as the material having low specific heat and low heat conductivity uniformly in the base rubber. In this embodiment, a multi-component glass balloon, specifically Model No: Z-27 made by Tokai Industries, Ltd., is applied. The density of glass balloon in this embodiment is not defined as an apparent density but as the true density determined independently for each filler.

The mixing amount of this glass balloon 14*b* is arranged in 15 parts.

A manufacturing process of the pressing roller 10 will be described.

The process has a beginning with preparing 500 g respectively for liquid A and liquid B of Silicon Rubber Model No:

X-34-1279 made by Shin-Etsu Chemical Co., Ltd. as the non-foamed rubber 14 of material and also preparing 150 g of Model No: Z-27 made by Tokai Industries, Ltd. as the glass balloon 14*b*. The liquid A and liquid B are then put into a closed mixer and mixed for about 5 minutes. Then, the rubber with uniformly dispersed glass balloon is degassed by a vacuum deaerator.

On the other hand, a stainless shaft making up the core 12 and a fluororesin tube making up the releasing layer 16 are positioned in a molding machine, and the degassed rubber with the glass balloon is injected into the molding machine for subjecting to a primary curing for 30 minutes in an oven heated at 150° C. Then, the roller is taken out of the molding machine and subjected to a secondary curing for 4 hours in a oven heated at 200° C. to bring the pressing roller to completion.

In the produced pressing roller 10, the glass balloon 14*b* is uniformly mixed in 15 parts with the non-foamed rubber 14*a* making up the elastic layer 14 so that both density and specific heat become lower as compared to the case where the elastic layer 14 is composed only of the non-foamed rubber. Consequently, the heat capacity per unit volume derived from multiplying the density and specific heat also decreases so that low heat capacity can be achieved and thermal responsiveness can be improved despite applying the non-foamed rubber 14*a* to the elastic layer 14. This allows the warming-up period of time to be shortened. It is apparent that low thermal expansion affected originally by applying the non-foamed rubber 14*a* can also be achieved.

The glass balloon is mixed by 15 parts in the above embodiment. This compound will now be referred to as A. A compound B mixed by 20 parts and a compound C mixed by 15 parts were separately prepared and formed into respective elastic layers 14. Then, each of density, specific heat, heat conductivity, compression set, and fixing rate of respective elastic layers 14 was determined in the same way as the first embodiment. The result is shown in Table 2.

As is apparent from Table 2, all heat gain amounts A of elastic layers 14 in respective compounds A, B, and C satisfies the inequality of the above-mentioned optimal range defined by $$0.0004 \leqq A \leqq 0.0037,$$

and have the same effects as the first embodiment.

However, in parallel with increasing the mixing amount of the glass balloon 14*b*, the hardness of the elastic layer 14 is undesirably increased. Thus, the mixing rate of the glass balloon would have an optimal range. This optimal range of the mixing rate of the glass balloon will now be verified.

According to the manufacturing process described in connection with the second embodiment, samples A to G were produced in which their mixing rates of the glass balloon 14*b* were arranged in 0 part (i.e. no mixing), 2 parts, 3 parts, 5 parts, 10 parts, 15 parts, 20 parts, 25 parts, and 30 parts, respectively. Then, each of density, specific heat, hardness, heat conductivity, and compression set was determined.

The density ρ was defined by a value ($g/cm^3$) derived from determining each volume ($cm^3$) and mass (g) of the samples A to G and then dividing the mass by the weight. The specific heat c was defined by a value (J/g·K) determined using a specific heat meter. The hardness was defined by a value determined C hardness using a hardness meter (Kobunshi Keiki Co., Ltd.: Model C) under 1 Kg load. The heat conductivity was defined by a value determined in a QTM heat conductivity meter (Kyoto Electronics Manufacturing Co., Ltd.). The compression set was defined by a value determined based on JIS K6301.

The result is shown in Table 3.

As is apparent from Table. 3, the density ρ and specific heat c decrease in parallel with increasing the mixing rate of the glass balloon 14*b*. As a result, it can be understood that the heat capacity per unit volume defined by density ρ×specific heat gradually decreases.

As a comparative example where the pressing roller is composed of a silicon sponge rubber roller, the value corresponding to Table 3 was determined. This silicon sponge rubber roller was produced through preparing a base rubber of KE904FU made by Shin-Etsu Chemical Co., Ltd, and then mixing 0.6 parts of C-24 and 3.0 of C-3 as curing agent, and 3 parts of KE-P-13 as foaming agent. The result corresponding to Table 3 is shown in Table 4.

Comparing Table 4 and Table 3, in the sample A with no mixed glass balloon 14*b*, that is, in case of the elastic layer 14 composed only of non-foamed rubber, the value of density ρ×specific heat c represents a extremely high value of 1.510 and an inferior thermal responsiveness as compared to 0.762 of density ρ×specific heat c for the elastic layer 14 composed of sponge rubber.

On the other hand, when the glass balloon 14*b* is mixed even by 3 parts, density ρ×specific heat c decreases to 1,322 so that thermal responsiveness is improved. Thus, it was proved that thermal responsiveness is improved by mixing 3 parts of glass balloon as compared to the elastic later 14 composed only of non-foamed rubber. The evaluation criteria of the rubber property in case of using for the pressing roller are as follows.

Hardness is preferably to be 65 degree or less which corresponds to the value of non-foamed rubber. Because more than 65 degree yields too much of stiffness so that the contacting portion to the heating roller is not resiliently deformed and the desired nip width cannot be obtained.

While there are not specific criteria for heat conductivity, lower heat conductivity is advantageously to shorten the warming-up period of time.

Compression set is preferably to be 20% or less which corresponds to sponge rubber. Because more than 20% of compression set undesirably makes a nip trace during waiting period, resulting in deteriorated image quality.

Considering the above evaluation criteria and the values of sponge rubber, it was proved that the mixing rate of the glass balloon 14*b* is preferably up to 25 parts. This means that the range where the value of density ρ×specific heat c satisfies the following formula (2) is optimal.

$$0.77 \leqq \rho \cdot c \leqq 1.32 \qquad (2)$$

In accordance with the experimental verification described above, the pressing roller 10 having the elastic layer 14 with the mixed glass balloon 14*b* was produced, and various effects were actually verified by mounting the produced elastic layer to the fixing apparatus.

For this verification, an inventive example 1 of the pressing roller 10 having the elastic layer 14 with 5 parts of glass balloon 14*b*, an inventive example 2 of the pressing roller 10 having the elastic layer 14 with 10 parts of glass balloon 14*b*, and an inventive example 3 of the pressing roller 10 having the elastic layer 14 with 15 parts of glass balloon 14*b* were produced. A comparative example 1 of a pressing roller having an elastic layer composed of the above mentioned sponge roller, and a comparative example 2 of a pressing roller having an elastic layer composed only of non-foamed rubber with no mixed glass balloon were also produced.

Each pressing rollers were incorporated in the fixing apparatus with being contacted to the heating roller to make 4 mm of the nip width and were rotated at 100 mm/sec of peripheral speed. With heating the heating roller 22 from a room temperature up to the fixing temperature, the change over time of the surface temperature of each the pressing roller was determined.

The result is shown in Table 5.

In order to compare the warming-up period of time for each pressing roller, the time needed for the surface temperature of each pressing roller to reach 130° C. is picked up and this result is shown in Table 6.

As is apparent from Table 4, the comparative example 2 (the pressing roller having the elastic layer composed only of non-foamed rubber) needs considerable long warming-up period of time as compared to the comparative example 1 (the pressing roller having the elastic layer composed of sponge rubber). In contrast, it was proved that the inventive examples 1 to 3 were not superior to the comparative example 1 but were significantly improved as compared to the comparative example 2.

The change in shape of each the pressing roller under heating was verified. With setting a temperature controlled bath at 180° C. The outside diameter of each the pressing roller was determined by a laser length-measuring device (Tokyo Opt-Electronics Co., Ltd.) respectively after 5 minutes, 10 minutes, 15 minutes, and 30 minutes after introducing each the pressing rollers into the above 180° C. of atmosphere.

Tables 7, 8, 9, 10 and 11 show results of respective pressure rolls of the inventive examples 1, 2, and 3, and the comparative examples 1 and 2, respectively.

In addition, respective results in Tables 7 to 11 are graphed out in FIGS. 8 to 12.

Referring to these FIGS. 8 to 10 and FIG. 12, in the inventive examples 1 to 3 and the comparative example 2, while the shape in the outside diameter is evidently expanded under heating, the change is substantially even in the axial direction of each pressing roller, so that corrugations in a sheet would not be caused due to this thermal change of the shape in the outside diameter (i.e. the shape of outside peripheral surface). This effect may be naturally expected because of applying non-foamed rubber as the base rubber of the elastic layer 14*a*.

Figure 11:
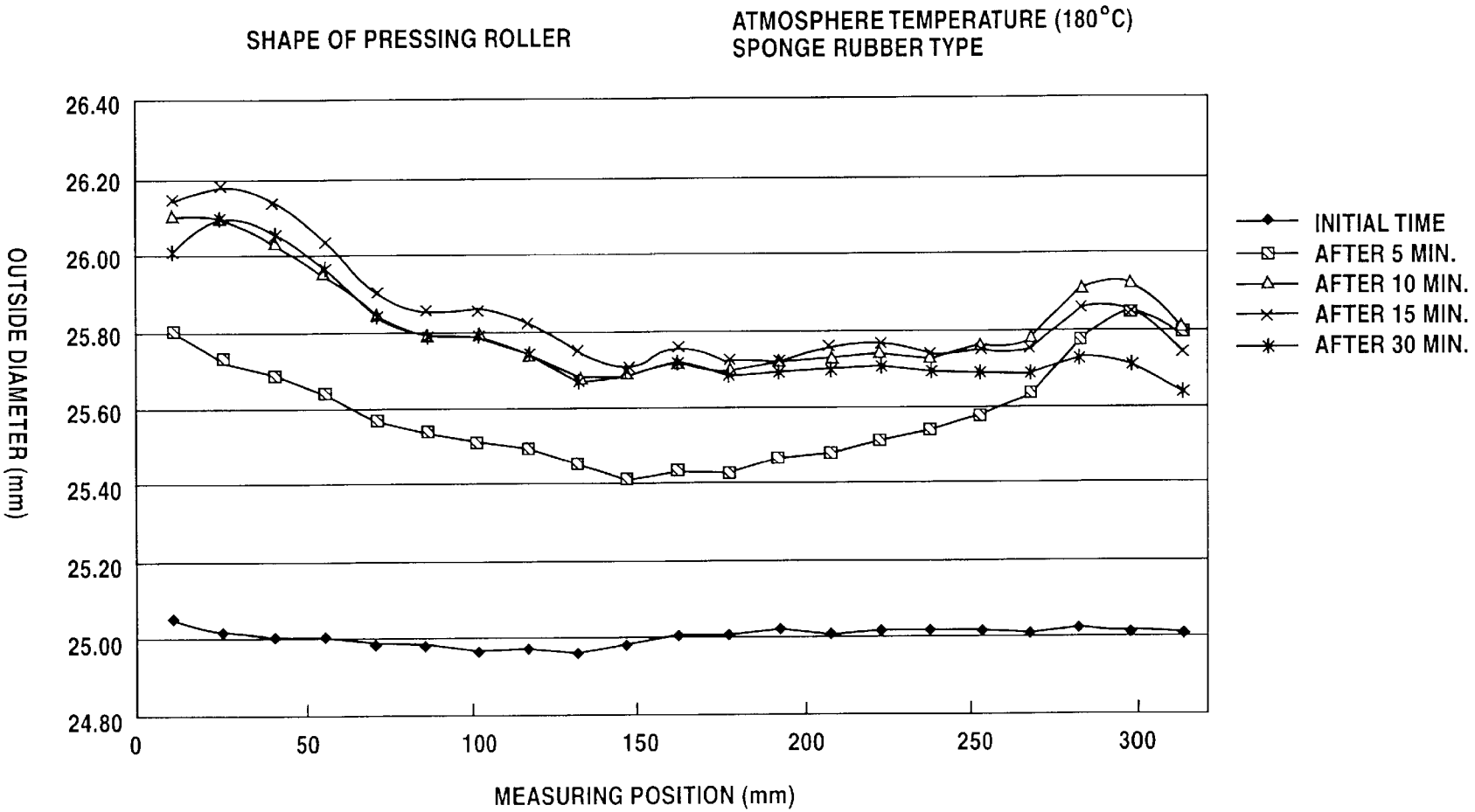
FIG. 11 is a diagrammatic view showing the change of the shape of a pressing roller over time, in case that the pressing roller having an elastic layer composed of sponge rubber is heated up.
Figure 12:
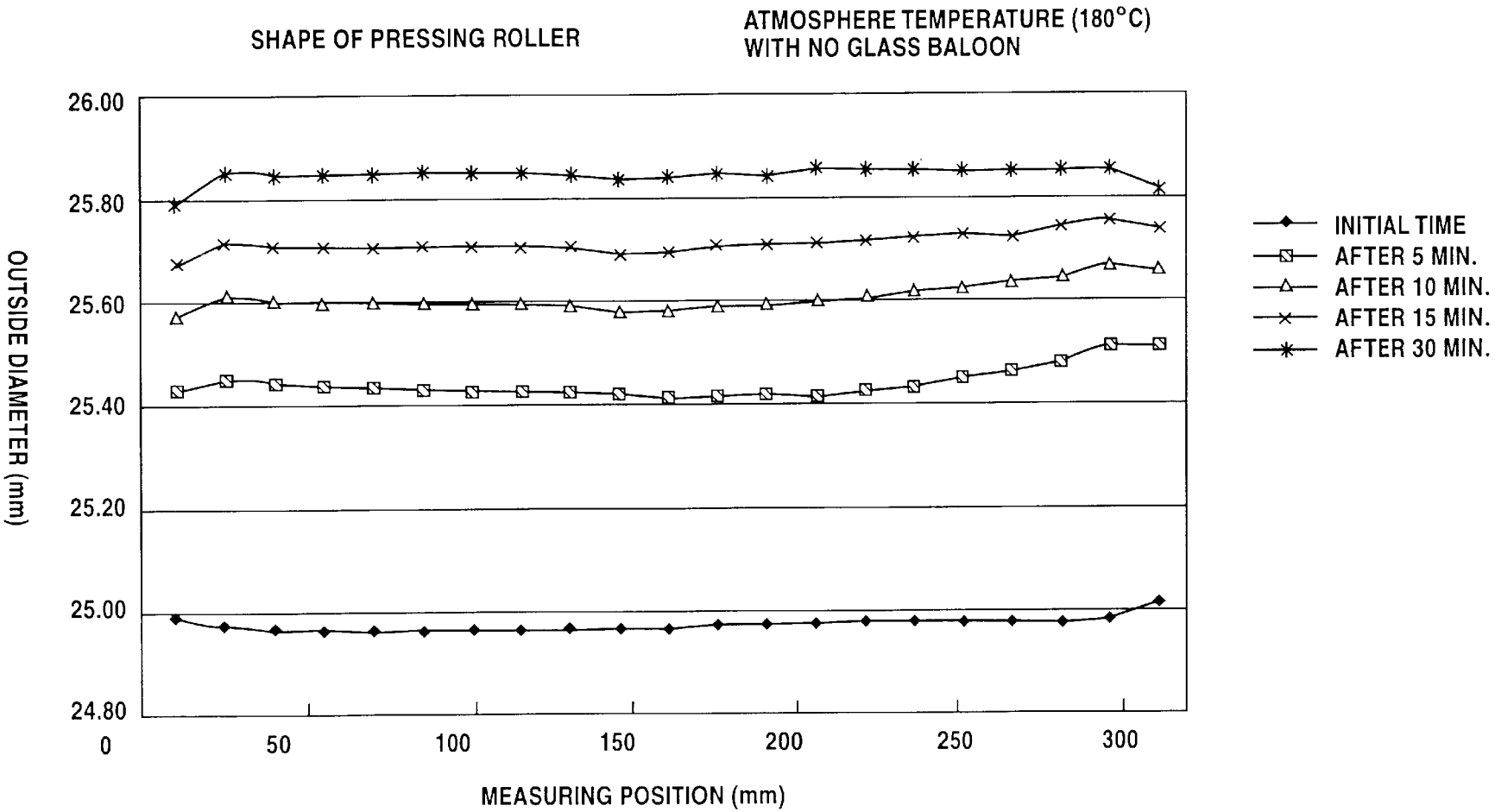
FIG. 12 is a diagrammatic view showing the change of the shape of a pressing roller over time, in case that the pressing roller having an elastic layer composed only of non-foamed rubber is heated up.

Referring to FIG. 11 of the comparative example 1, as described in the context of the background of the invention, it can be understood that the thermal deformation appears in the axial direction of the pressing roller to cause corrugations in a sheet, as a particular problem of sponge rubber.

The changing amount at each the lapsed time is picked up from Tables 7 to 9 and Table 11 and this result is shown Table 12.

Figure 13:
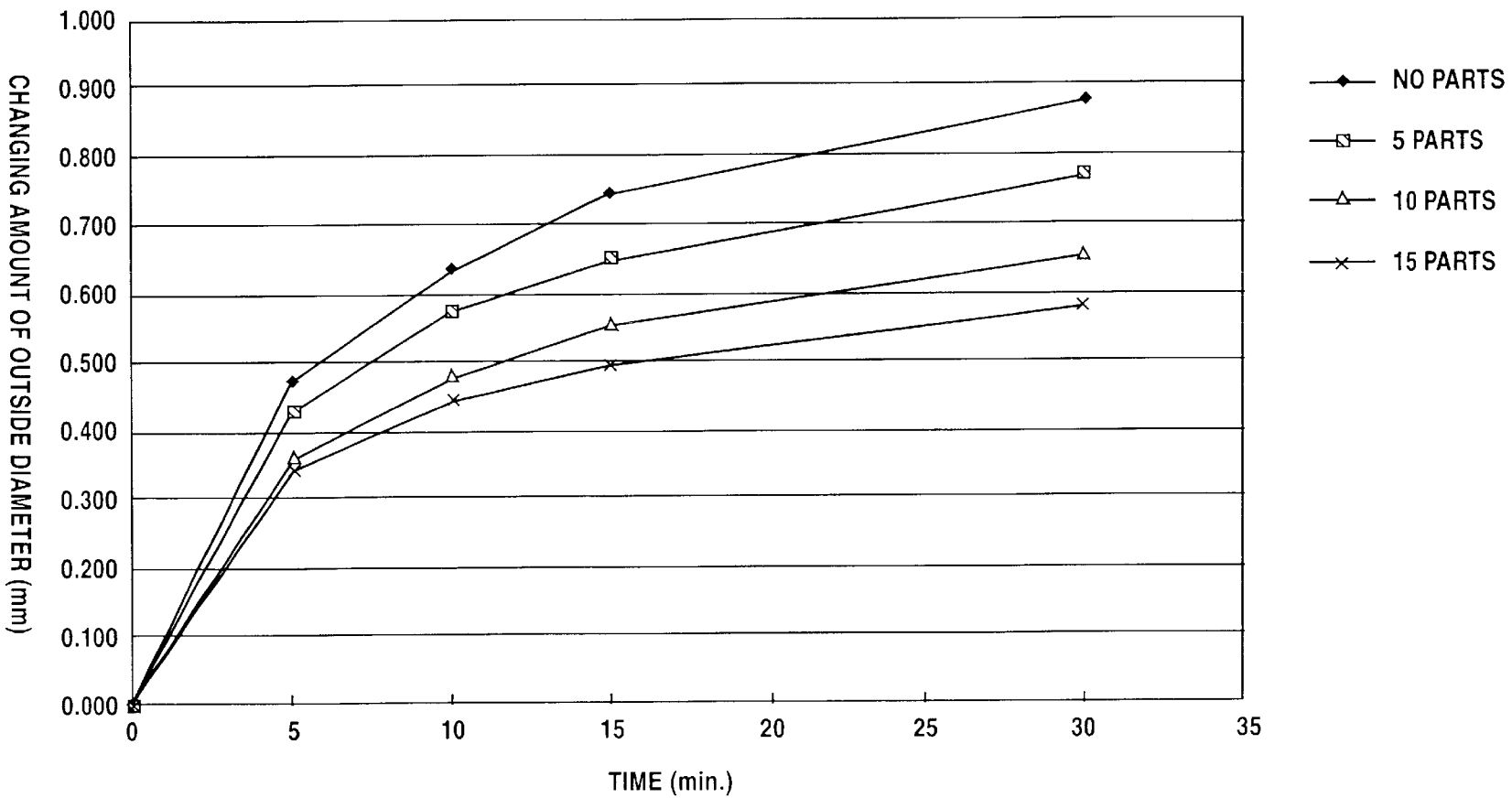
FIG. 13 is a diagrammatic view showing the relationship between mixing ratio of glass balloon and changing amount of outside diameter of a heating roller.

The result in Table 12 is graphed out in FIG. 13. Based on FIG. 13, it was proved that increasing the mixing rate of the glass balloon desirably makes the changing amount of outside diameter under heating smaller.

It should be understood that the present invention is not limited to the embodiments described above and many other variations and modifications may be made without departing from the spirit and scope of the present invention.

Figure 14:
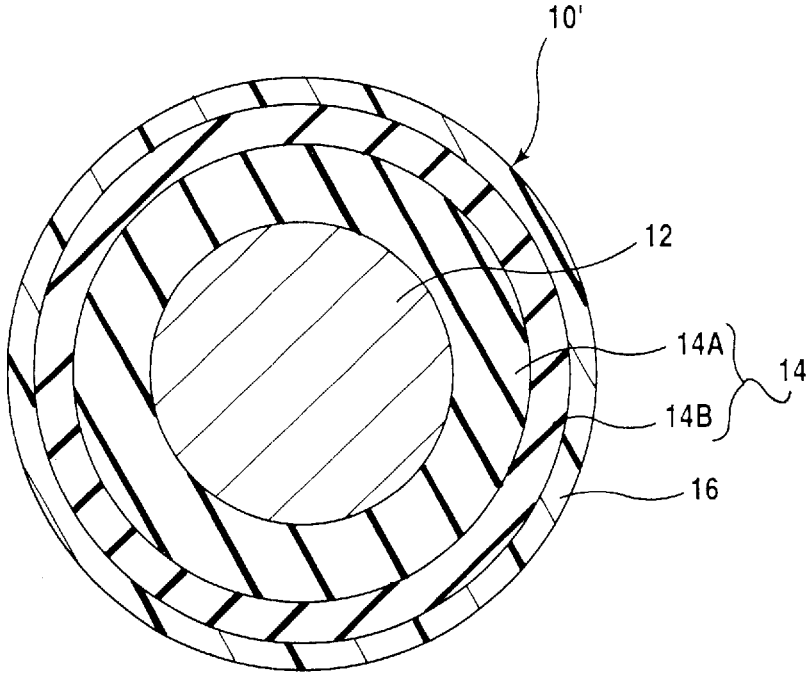
FIG. 14 is a front cross-sectional view showing a rubber fixing-roller according to another embodiment of the present invention.
Figure 15:
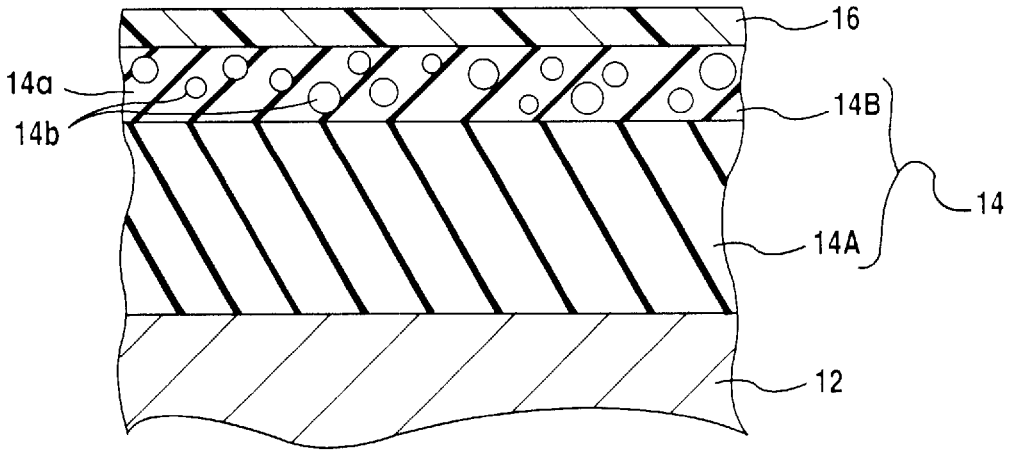
FIG. 15 is a cross-sectional view showing the rubber fixing-roller in FIG. 14.

For instance, while the glass balloon has been described to disperse all over the elastic layer 14 in the above embodiment, the present invention is not limited to this structure. Specifically, in a pressing roller 10' shown in FIGS. 14 and 15 according to another embodiment of the present invention, the elastic layer 14 may be configured as two-layers structure composed of a lower layer 14A of the core 12 and an upper layer 14B located on the surface side. In this case, the glass balloon 14*b* may be dispersed uniformly in the upper layer 14B of the non-foamed rubber 14*a*. That is, it is not necessary to disperse the glass balloon 14*b* in the lower layer 14A partially making up the elastic layer 14. The thickness of the upper layer 14B is sufficiently to be 2 mm.

Further, while the filler having low density and low specific heat has been described as a glass balloon, i.e. a multi-component glass balloon, such as alumina silicate glass or borosilicate soda glass, in the above embodiment, the present invention is not limited to this structure. For instance, a Shirasu balloon of volcanic glass or carbon balloon, a resinous balloon, or a metallic balloon may be applied. That is, any suitable balloons which allows the elastic layer 14 to have a density and specific heat so as to make the heat capacity of the elastic layer 14 lower than that of non-foamed rubber 14*a* itself.

Further, while the elastic layer of the pressing roller has been described to make from a silicone rubber with the dispersed glass balloon as the filler having low density and low specific heat in the above embodiment, the present invention is not limited to this structure. It is apparent that low heat capacity may be achieved by applying the silicon rubber as the heating roller.

As described above, according to the present invention, a rubber fixing-roller is provided which is capable of increasing temperature-rising rate of the fixing member by limiting the rate and amount of heat-transfer from the fixing member as small as possible. In addition, a rubber fixing-roller is provided which is capable of achieving a stable fixing operation during a sheet is passed therethrough by limiting the rate and amount of heat-transfer from the fixing member as small as possible.

Further, according to the present invention, there is provided a rubber fixing-roller capable of assuring a sufficient nip width and achieving low heat capacity without using sponge rubber.

Further, according to the present invention, there is provided a rubber fixing-roller capable of assuring a sufficient nip width and preventing a sheet from having corrugations even just after the completion of warming-up period of time.

Further, according to the present invention, there is provided a rubber fixing-roller capable of assuring a sufficient nip width and shortening the warming-up period of time.

TABLE 1

| FORMING RATIO % | FILLING FACTOR vol % | DENSITY g/cm$^3$ | SPECIFIC HEAT J/g · K | HEAT CONDUCTIVITY W/m · K | PERMANENT COMPRESSION SET % | | FIXING RATE % | | TEMPERATURE RISING-TIME sec | HEAT GAIN AMOUNT (A) J$^2$/sec · cm$^4$ · K$^2$ | |
|---|---|---|---|---|---|---|---|---|---|---|---|
| 102 | 2.0 | 1.160 | 1.50 | 0.241 | 15 | ○ | 77 | x | 52 | 4.19E-03 | x |
| 105 | 4.8 | 1.124 | 1.49 | 0.224 | 16 | ○ | 81 | x | 52 | 3.75E-03 | x |
| 110 | 9.1 | 1.073 | 1.47 | 0.203 | 17 | ○ | 86 | Δ | 51 | 3.20E-03 | ○ |

TABLE 1-continued

| FORMING RATIO % | FILLING FACTOR vol % | DENSITY g/cm$^3$ | SPECIFIC HEAT J/g · K | HEAT CONDUC-TIVITY W/m · K | PERMANENT COMPRESSION SET % | | FIXING RATE % | | TEMPERATURE RISING-TIME sec | HEAT GAIN AMOUNT (A) J$^2$/sec · cm$^4$ · K$^2$ | |
|---|---|---|---|---|---|---|---|---|---|---|---|
| 125 | 20.8 | 0.944 | 1.45 | 0.178 | 19 | ○ | 90 | ○ | 48 | 2.43E-03 | ○ |
| 150 | 33.3 | 0.780 | 1.43 | 0.148 | 21 | ○ | 92 | ○ | 45 | 1.65E-03 | ○ |
| 175 | 42.9 | 0.674 | 1.42 | 0.128 | 23 | ○ | 93 | ○ | 42 | 1.23E-03 | ○ |
| 200 | 50.0 | 0.590 | 1.40 | 0.416 | 25 | ○ | 93 | ○ | 40 | 9.58E-04 | ○ |
| 225 | 55.6 | 0.524 | 1.38 | 0.104 | 28 | ○ | 95 | ◎ | 36 | 7.51E-04 | ○ |
| 250 | 60.0 | 0.472 | 1.36 | 0.097 | 30 | ○ | 95 | ◎ | 33 | 6.23E-04 | ○ |
| 275 | 63.6 | 0.429 | 1.32 | 0.088 | 33 | ○ | 95 | ◎ | 29 | 4.98E-04 | ○ |
| 300 | 66.7 | 0.393 | 1.30 | 0.082 | 36 | ○ | 96 | ◎ | 27 | 4.19E-04 | ○ |
| 325 | 69.2 | 0.363 | 1.25 | 0.077 | 40 | x | 96 | ◎ | 24 | 3.49E-04 | x |

HEAT GAIN AMOUNT (A) = SPECIFIC HEAT × DENSITY × HEAT CONDUCTIVITY

TABLE 2

| | FILLING FACTOR vol % | DENSITY g/cm$^3$ | SPECIFIC HEAT J/g · K | HEAT CONDUC-TIVITY W/m · K | PERMANENT COMPRESSION SET % | | FIXING RATE % | | TEMPERATURE RISING-TIME sec | HEAT GAIN AMOUNT (A) J$^2$/sec · cm$^4$ · K$^2$ | |
|---|---|---|---|---|---|---|---|---|---|---|---|
| COMPOUND (A) | 41.4 | 0.940 | 1.01 | 0.221 | 12 | ○ | 92 | ○ | 50 | 2.10E-03 | ○ |
| COMPOUND (B) | 48.5 | 0.860 | 0.98 | 0.195 | 15 | ○ | 94 | ○ | 48 | 1.64E-03 | ○ |
| COMPOUND (C) | 54.1 | 0.820 | 0.95 | 0.174 | 19 | ○ | 95 | ◎ | 45 | 1.36E-03 | ○ |

HEAT GAIN AMOUNT (A) = SPECIFIC HEAT × DENSITY × HEAT CONDUCTIVITY

TABLE 3

| MIXING RATE OF GLASS BALOON PARTS | DENSITY g/cm$^3$ | SPECIFIC HEAT J/g · K | DENSITY × SPECIFIC HEAT J/cm$^3$ · K | HARDNESS ASKER C | | HEAT CONDUCT-TICITY W/m · K | PERMANENT COMPRESSION SET % | |
|---|---|---|---|---|---|---|---|---|
| 0 | 1.28 | 1.18 | 1.510 | 18 | ○ | 0.31 | 3 | ○ |
| 2 | 1.21 | 1.15 | 1.392 | 23 | ○ | 0.30 | 4 | ○ |
| 3 | 1.18 | 1.12 | 1.322 | 26 | ○ | 0.29 | 5 | ○ |
| 5 | 1.15 | 1.07 | 1.231 | 28 | ○ | 0.28 | 6 | ○ |
| 10 | 1.04 | 1.03 | 1.071 | 36 | ○ | 0.25 | 9 | ○ |
| 15 | 0.94 | 1.01 | 0.949 | 46 | ○ | 0.23 | 12 | ○ |
| 20 | 0.86 | 0.98 | 0.843 | 55 | ○ | 0.21 | 15 | ○ |
| 25 | 0.82 | 0.95 | 0.779 | 64 | ○ | 0.20 | 19 | ○ |
| 30 | 0.78 | 0.92 | 0.718 | 73 | x | 0.19 | 24 | x |

TABLE 4

| DENSITY g/cm$^3$ | SPECIFIC HEAT J/g · K | DENSITY × SPECIFIC HEAT HARDNESS J/cm$^3$ · K | HARDNESS ASKER C | HEAT CONDUCT-TICITY W/m · K | PERMANENT COMPRESSION SET % |
|---|---|---|---|---|---|
| 0.63 | 1.21 | 0.762 | 30 | 0.08 | 18 |

TABLE 5

| TIME (sec) | SPONGE TYPE H/R 178~183° C. | WITH NO GLASS BALOON H/R 178~182° C. | WITH 5 PARTS OF GLASS BALOON H/R 179~182° C. | WITH 10 PARTS OF GLASS BALOON H/R 178~182° C. | WITH 15 PARTS OF GLASS BALOON H/R 178~182° C. |
|---|---|---|---|---|---|
| 0 | 25.2 | 25.2 | 25.2 | 25.2 | 25.2 |
| 5 | 31.4 | 29.0 | 30.3 | 30.5 | 31.2 |
| 10 | 41.4 | 33.9 | 36.9 | 37.6 | 38.8 |
| 15 | 52.0 | 43.5 | 46.4 | 47.6 | 48.2 |
| 20 | 64.1 | 54.5 | 57.2 | 58.8 | 61.3 |
| 25 | 77.8 | 64.0 | 66.6 | 69.9 | 72.2 |

TABLE 5-continued

| TIME (sec) | SPONGE TYPE H/R 178~183° C. | WITH NO GLASS BALOON H/R 178~182° C. | WITH 5 PARTS OF GLASS BALOON H/R 179~182° C. | WITH 10 PARTS OF GLASS BALOON H/R 178~182° C. | WITH 15 PARTS OF GLASS BALOON H/R 178~182° C. |
|---|---|---|---|---|---|
| 30 | 90.0 | 73.8 | 77.5 | 80.8 | 82.5 |
| 40 | 112.0 | 93.3 | 98.2 | 103.5 | 107.4 |
| 50 | 134.5 | 114.0 | 121.2 | 124.5 | 129.2 |
| 60 | 144.0 | 128.5 | 134.2 | 136.0 | 137.7 |
| 90 | 150.4 | 139.9 | 143.8 | 144.2 | 145.8 |
| 120 | 151.4 | 143.8 | 147.8 | 148.7 | 149.5 |
| 150 | 152.3 | 146.5 | 149.4 | 150.2 | 150.7 |
| 180 | 153.3 | 149.0 | 151.7 | 151.9 | 152.1 |
| 210 | 153.8 | 150.7 | 152.1 | 153.1 | 153.4 |
| 240 | 154.2 | 151.8 | 153.7 | 154.5 | 154.7 |

TABLE 6

| | TIME(SEC.) |
|---|---|
| SPONGE TYPE | 47 |
| WITH NO GLASS BALOON | 62 |
| WITH 2 PARTS OF GLASS BALOON | 61 |
| WITH 3 PARTS OF GLASS BALOON | 58 |
| WITH 5 PARTS OF GLASS BALOON | 55 |
| WITH 10 PARTS OF GLASS BALOON | 53 |
| WITH 15 PARTS OF GLASS BALOON | 50 |

TABLE 7

| | INITIAL | 5 MIN. | 10 MIN. | 15 MIN. | 30 MIN. |
|---|---|---|---|---|---|
| 10.0 | 25.083 | 25.484 | 25.612 | 25.684 | 25.808 |
| 25.1 | 25.083 | 25.499 | 25.642 | 25.716 | 25.851 |
| 40.2 | 25.066 | 25.478 | 25.626 | 25.703 | 25.840 |
| 55.3 | 25.062 | 25.471 | 25.622 | 25.702 | 25.840 |
| 70.4 | 25.059 | 25.470 | 25.619 | 25.702 | 25.839 |
| 85.5 | 25.058 | 25.467 | 25.616 | 25.700 | 25.836 |
| 100.6 | 25.057 | 25.462 | 25.614 | 25.700 | 25.835 |
| 115.7 | 25.056 | 25.462 | 25.613 | 25.702 | 25.832 |
| 130.8 | 25.059 | 25.460 | 25.603 | 25.696 | 25.823 |
| 145.9 | 25.058 | 25.459 | 25.602 | 25.684 | 25.817 |
| 161.0 | 25.058 | 25.448 | 25.611 | 25.701 | 25.826 |
| 176.1 | 25.059 | 25.454 | 25.612 | 25.698 | 25.831 |
| 191.2 | 25.057 | 25.462 | 25.617 | 25.702 | 25.829 |
| 206.3 | 25.055 | 25.465 | 25.624 | 25.707 | 25.836 |
| 221.4 | 25.054 | 25.477 | 25.635 | 25.712 | 25.833 |
| 236.5 | 25.054 | 25.491 | 25.646 | 25.719 | 25.830 |
| 251.6 | 25.055 | 25.510 | 25.659 | 25.727 | 25.831 |
| 266.7 | 25.058 | 25.535 | 25.675 | 25.736 | 25.833 |
| 281.8 | 25.062 | 25.566 | 25.696 | 25.750 | 25.835 |
| 296.9 | 25.075 | 25.606 | 25.723 | 25.767 | 25.836 |
| 312.0 | 25.086 | 25.619 | 25.716 | 25.750 | 25.810 |
| Ave. | 25.063 | 25.493 | 25.637 | 25.712 | 25.831 |

TABLE 8

| | INITIAL | 5 MIN. | 10 MIN. | 15 MIN. | 30 MIN. |
|---|---|---|---|---|---|
| 10.0 | 25.186 | 25.510 | 25.605 | 25.657 | 25.749 |
| 25.1 | 25.182 | 25.505 | 25.608 | 25.669 | 25.762 |
| 40.2 | 25.160 | 25.485 | 25.590 | 25.653 | 25.752 |
| 55.3 | 25.152 | 25.479 | 25.585 | 25.651 | 25.749 |
| 70.4 | 25.149 | 25.475 | 25.583 | 25.648 | 25.747 |
| 85.5 | 25.145 | 25.472 | 25.581 | 25.645 | 25.744 |
| 100.6 | 25.144 | 25.470 | 25.580 | 25.644 | 25.742 |
| 115.7 | 25.143 | 25.467 | 25.578 | 25.642 | 25.739 |
| 130.8 | 25.145 | 25.465 | 25.569 | 25.631 | 25.733 |
| 145.9 | 25.148 | 25.464 | 25.569 | 25.617 | 25.723 |
| 161.0 | 25.147 | 25.462 | 25.579 | 25.638 | 25.726 |
| 176.1 | 25.149 | 25.470 | 25.580 | 25.638 | 25.728 |
| 191.2 | 25.149 | 25.472 | 25.587 | 25.641 | 25.729 |

TABLE 8-continued

| | INITIAL | 5 MIN. | 10 MIN. | 15 MIN. | 30 MIN. |
|---|---|---|---|---|---|
| 206.3 | 25.151 | 25.483 | 25.595 | 25.647 | 25.737 |
| 221.4 | 25.153 | 25.493 | 25.605 | 25.657 | 25.740 |
| 236.5 | 25.156 | 25.504 | 25.612 | 25.661 | 25.739 |
| 251.6 | 25.157 | 25.517 | 25.621 | 25.668 | 25.736 |
| 266.7 | 25.160 | 25.538 | 25.635 | 25.676 | 25.737 |
| 281.8 | 25.162 | 25.559 | 25.648 | 25.683 | 25.737 |
| 296.9 | 25.175 | 25.590 | 25.668 | 25.694 | 25.739 |
| 312.0 | 25.192 | 25.611 | 25.673 | 25.695 | 25.728 |
| Ave. | 25.157 | 25.500 | 25.602 | 25.655 | 25.739 |

TABLE 9

| | INITIAL | 5 MIN. | 10 MIN. | 15 MIN. | 30 MIN. |
|---|---|---|---|---|---|
| 10.0 | 25.178 | 25.511 | 25.624 | 25.695 | 25.798 |
| 25.1 | 25.189 | 25.531 | 25.651 | 25.725 | 25.838 |
| 40.2 | 25.185 | 25.531 | 25.652 | 25.727 | 25.845 |
| 55.3 | 25.180 | 25.528 | 25.650 | 25.725 | 25.848 |
| 70.4 | 25.179 | 25.525 | 25.649 | 25.731 | 25.845 |
| 85.5 | 25.178 | 25.523 | 25.646 | 25.726 | 25.845 |
| 100.6 | 25.177 | 25.520 | 25.644 | 25.725 | 25.843 |
| 115.7 | 25.176 | 25.518 | 25.641 | 25.727 | 25.837 |
| 130.8 | 25.177 | 25.516 | 25.637 | 25.727 | 25.835 |
| 145.9 | 25.173 | 25.506 | 25.630 | 25.718 | 25.826 |
| 161.0 | 25.168 | 25.508 | 25.634 | 25.707 | 25.822 |
| 176.1 | 25.174 | 25.508 | 25.642 | 25.717 | 25.837 |
| 191.2 | 25.170 | 25.517 | 25.643 | 25.726 | 25.831 |
| 206.3 | 25.166 | 25.516 | 25.648 | 25.722 | 25.829 |
| 221.4 | 25.165 | 25.519 | 25.653 | 25.730 | 25.828 |
| 236.5 | 25.164 | 25.532 | 25.659 | 25.728 | 25.827 |
| 251.6 | 25.163 | 25.543 | 25.670 | 25.742 | 25.827 |
| 266.7 | 25.163 | 25.562 | 25.681 | 25.741 | 25.826 |
| 281.8 | 25.164 | 25.585 | 25.694 | 25.754 | 25.819 |
| 296.9 | 25.168 | 25.607 | 25.703 | 25.754 | 25.813 |
| 312.0 | 25.166 | 25.610 | 25.689 | 25.730 | 25.778 |
| Ave. | 25.173 | 25.534 | 25.654 | 25.727 | 25.828 |

TABLE 10

| | INITIAL | 5 MIN. | 10 MIN. | 15 MIN. | 30 MIN. |
|---|---|---|---|---|---|
| 10.0 | 24.990 | 25.433 | 25.579 | 25.678 | 25.797 |
| 25.1 | 24.975 | 25.456 | 25.613 | 25.720 | 25.856 |
| 40.2 | 24.968 | 25.448 | 25.606 | 25.713 | 25.852 |
| 55.3 | 24.967 | 25.443 | 25.604 | 25.713 | 25.853 |
| 70.4 | 24.965 | 25.439 | 25.603 | 25.711 | 25.855 |
| 85.5 | 24.965 | 25.437 | 25.601 | 25.711 | 25.856 |
| 100.6 | 24.966 | 25.433 | 25.601 | 25.713 | 25.856 |
| 115.7 | 24.966 | 25.432 | 25.599 | 25.710 | 25.856 |
| 130.8 | 24.967 | 25.431 | 25.597 | 25.709 | 25.850 |
| 145.9 | 24.968 | 25.426 | 25.585 | 25.696 | 25.842 |
| 161.0 | 24.969 | 25.418 | 25.587 | 25.693 | 25.844 |

TABLE 10-continued

| | INITIAL | 5 MIN. | 10 MIN. | 15 MIN. | 30 MIN. |
|---|---|---|---|---|---|
| 176.1 | 24.975 | 25.421 | 25.597 | 25.711 | 25.852 |
| 191.2 | 24.977 | 25.425 | 25.598 | 25.713 | 25.848 |
| 206.3 | 24.978 | 25.420 | 25.603 | 25.717 | 25.862 |
| 221.4 | 24.981 | 25.432 | 25.611 | 25.722 | 25.860 |
| 236.5 | 24.981 | 25.438 | 25.623 | 25.728 | 25.860 |
| 251.6 | 24.980 | 25.456 | 25.630 | 25.733 | 25.856 |
| 266.7 | 24.979 | 25.469 | 25.641 | 25.729 | 25.857 |
| 281.8 | 24.979 | 25.489 | 25.650 | 25.748 | 25.858 |
| 296.9 | 24.986 | 25.516 | 25.673 | 25.760 | 25.859 |
| 312.0 | 25.017 | 25.518 | 25.661 | 25.744 | 25.820 |
| Ave. | 24.976 | 25.447 | 25.612 | 25.718 | 25.850 |

TABLE 11

| | INITIAL | 5 MIN. | 10 MIN. | 15 MIN. | 30 MIN. |
|---|---|---|---|---|---|
| 10.0 | 25.047 | 25.805 | 26.107 | 26.143 | 26.011 |
| 25.1 | 25.014 | 25.728 | 26.094 | 26.184 | 26.101 |
| 40.2 | 25.004 | 25.686 | 26.033 | 26.142 | 26.055 |
| 55.3 | 25.000 | 25.638 | 25.953 | 26.032 | 25.968 |
| 70.4 | 24.986 | 25.569 | 25.845 | 25.903 | 25.850 |
| 85.5 | 24.984 | 25.536 | 25.803 | 25.858 | 25.794 |
| 100.6 | 24.966 | 25.512 | 25.794 | 25.865 | 25.790 |
| 115.7 | 24.971 | 25.493 | 25.740 | 25.828 | 25.748 |
| 130.8 | 24.964 | 25.454 | 25.686 | 25.751 | 25.676 |
| 145.9 | 24.983 | 25.412 | 25.689 | 25.709 | 25.693 |
| 161.0 | 25.006 | 25.433 | 25.724 | 25.762 | 25.722 |
| 176.1 | 25.007 | 25.430 | 25.698 | 25.726 | 25.685 |
| 191.2 | 25.017 | 25.467 | 25.725 | 25.729 | 25.699 |
| 206.3 | 25.009 | 25.479 | 25.737 | 25.762 | 25.702 |
| 221.4 | 25.017 | 25.516 | 25.747 | 25.773 | 25.712 |
| 236.5 | 25.019 | 25.541 | 25.731 | 25.746 | 25.698 |
| 251.6 | 25.020 | 25.583 | 25.762 | 25.756 | 25.695 |
| 266.7 | 25.011 | 25.639 | 25.782 | 25.760 | 25.691 |
| 281.8 | 25.025 | 25.780 | 25.914 | 25.865 | 25.734 |
| 296.9 | 25.018 | 25.854 | 25.930 | 25.861 | 25.716 |
| 312.0 | 25.012 | 25.802 | 25.817 | 25.752 | 25.643 |

TABLE 12

| | NO PARTS | 5 PARTS | 10 PARTS | 15 PARTS |
|---|---|---|---|---|
| 0 | 0 | 0 | 0 | 0 |
| 5 | 0.527 | 0.43 | 0.361 | 0.343 |
| 10 | 0.535 | 0.574 | 0.481 | 0.445 |
| 15 | 0.742 | 0.649 | 0.554 | 0.498 |
| 30 | 0.874 | 0.768 | 0.655 | 0.582 |

What is claimed is:

1. A rubber fixing-roller comprising a core and an elastic layer provided on the periphery of said core, said elastic layer is adapted to satisfy the following formula;

$$0.0004 \leqq A \leqq 0.0037$$

where A ($J^2/sec \cdot cm^4 \cdot K^2$) is a product value from the specific heat (J/g·K), density ($g/cm^3$), and heat conductivity (W/m·K) of said elastic layer.

2. The rubber fixing-roller as defined in claim 1, wherein the peripheral surface of said elastic layer is covered with a releasing layer.

3. The rubber fixing-roller as defined in claim 2, wherein said releasing layer includes a fluororesin.

4. The rubber fixing-roller as defined in claim 1, wherein said elastic layer includes a material having low specific heat and low heat conductivity dispersed in said elastic layer.

5. The rubber fixing-roller as defined in claim 4, wherein said elastic layer includes a cellular rubber.

6. The rubber fixing-roller as defined in claim 5, wherein said cellular rubber is a foamed rubber.

7. The rubber fixing-roller as defined in claim 4, wherein said elastic layer includes a rubber with which a hollow filler is dispersedly mixed, as the material having low specific heat and low heat conductivity.

8. The rubber fixing-roller as defined in claim 7, wherein said hollow filler is a glass balloon.

9. The rubber fixing-roller as defined in claim 4, wherein said elastic layer includes a silicon rubber.

10. The rubber fixing-roller as defined in either one of claims 1 to 9, wherein said rubber fixing-roller is positioned to contact to a fixing member with a predetermined pressure.

11. A rubber fixing-roller comprising a core and a non-foamed rubber elastic layer provided on the periphery of said core, said elastic layer including a peripheral surface having a predetermined outside diameter, said elastic layer being prepared in a predetermined heat capacity per unit volume by mixing a filler having low density and low specific heat.

12. The rubber fixing-roller as defined in claim 11, wherein the peripheral surface of said elastic layer is covered with a releasing layer.

13. The rubber fixing-roller as defined in claim 12, wherein said releasing layer includes a fluororesin.

14. The rubber fixing-roller as defined in claim 11, wherein said filler having low density and low specific heat is a hollow material.

15. The rubber fixing-roller as defined in claim 11 or 14, wherein said filler having low density and low specific heat includes a multi-component glass.

16. The rubber fixing-roller as defined in claim 11 or 14, wherein said rubber fixing-roller is adapted to satisfy the following formula;

$$0.77 \leqq \rho \cdot c \leqq 1.32$$

where ρ is a density ($g/cm^3$) and c is a specific heat (J/g·K), in the range of from said peripheral surface of said elastic layer to at least 2 mm in depth.

17. The rubber fixing-roller as defined in claim 16, wherein said filler having low density and low specific heat is not mixed in the range deeper than 2 mm in depth from said peripheral surface of said elastic layer.

18. The rubber fixing-roller as defined in claim 11 or 14, wherein said rubber fixing-roller is adapted to satisfy the following formula;

$$0.77 \leqq \rho \cdot c \leqq 1.32$$

where ρ is a density ($g/cm^3$) and c is a specific heat (J/g·K), in the entire range of said elastic layer.

* * * * *